US005263834A

United States Patent [19]

Sato et al.

[11] Patent Number: 5,263,834

[45] Date of Patent: Nov. 23, 1993

[54] REFRIGERANT COMPRESSOR USING REFRIGERANT HFC134A OR HFC152A

[75] Inventors: Shinobu Sato; Shoichiro Kitaichi, both of Kanagawa, Japan

[73] Assignee: Kabushiki Kaisha Toshiba, Kangawa, Japan

[21] Appl. No.: 894,556

[22] Filed: Jun. 5, 1992

[30] Foreign Application Priority Data

Jun. 7, 1991 [JP] Japan ..... 3-136122

[51] Int. Cl.[5] ..... F01C 21/00; F03C 2/00

[52] U.S. Cl. ..... 418/178; 418/179; 418/97

[58] Field of Search ..... 418/178, 179, 97, 98, 418/99; 417/DIG. 1, 902

[56] References Cited

U.S. PATENT DOCUMENTS

| | | | |
|---|---|---|---|
| 3,239,135 | 3/1966 | Fritz | 418/178 |
| 4,944,663 | 7/1990 | Iizuka et al. | 418/178 |
| 5,090,882 | 2/1992 | Serizawa et al. | 418/179 |

FOREIGN PATENT DOCUMENTS

| | | | |
|---|---|---|---|
| 0017385 | 1/1987 | Japan | 418/178 |
| 0071591 | 3/1988 | Japan | 418/178 |
| 1-48388 | 10/1989 | Japan . | |

OTHER PUBLICATIONS

S. C. Kang and K. C. Ludema; The Breaking-In of Lubricated Surfaces, Wear, 108 (1986) pp. 375-384.

*Primary Examiner*—Richard A. Bertsch
*Assistant Examiner*—Charles G. Freay
*Attorney, Agent, or Firm*—Finnegan, Henderson, Farabow, Garrett & Dunner

[57] ABSTRACT

A hermetic type refrigerant compressor operates using a refrigerant and a refrigerator oil in which the refrigerant is soluble. The refrigerant compressor includes slidable members adapted to slidably move and a compressing mechanism for compressing the refrigerant with the aid of the slidable members in a hermetic casing. The refrigerant, the refrigerator oil and the slidable members are selected and constructed in the following manner. The refrigerant is a 1,1,1,2-tetrafluoroethane or a 1,1-difluoroethane, the refrigerator oil is at least one kind of refrigerator oil selected from a polyalkylene glycol based oil and a polyester based oil, and at least one of the slidable members has a slidable surface which is prepared such that a surface hardened layer having a Vickers hardness of 400 or more and a thickness of 2 microns or more is formed on a substrate of ferrous metallic material, and subsequently, an iron oxide layer composed of $Fe_3O_4$ as a main component and having a thickness of 0.01 micron or more is formed on the surface hardened layer. Each slidable member has surfaces each of which exhibits especially improved abrasion resistance.

9 Claims, 4 Drawing Sheets

REFRIGERANT COMPRESSOR USING REFRIGERANT HFC134A OR HFC152A

BACKGROUND OF THE INVENTION

The present invention relates to a refrigerant compressor adapted to operate using a 1,1,1,2-tetrafluoroethane (hereinafter referred to as HFC134a) or a 1,1-difluoroethane (hereinafter referred to as HFC152a) as a refrigerant and a refrigerator oil in which the foregoing refrigerant is soluble.

Generally, a room air conditioner, automobile air conditioner, refrigerator, and so forth use a refrigerant compressor for blowing cold air or hot air. As refrigerant compressors, hermetic type refrigerant compressor, automobile type semi-hermetic refrigerant compressor, and so forth are known.

A typical hermetic type rotary refrigerant compressor as shown in FIG. 1 that is a vertical sectional view will be described below as an example.

Referring to FIG. 1, a drive motor (not shown) is accommodated in a casing 1. A shaft 2 to be rotated by the drive motor (not shown) extends through a cylinder 4 while it is rotatably supported by bearings, and the lowermost end of the shaft 2 is rotatably supported by a subbearing 5.

The shaft 2 includes a crank portion (eccentric portion) in the cylinder 4. A roller 6 fitted between the crank portion and the cylinder 4 conducts planetary movement as the shaft 2 is rotated.

In addition, the refrigerant compressor includes a blade 7 which extends through the cylinder 4. The inner end of the blade 7 comes in contact with the outer periphery of the roller 6 under the effect of the biasing force given by a spring 8, whereby the interior of the cylinder 4 is divided into a suction chamber and a discharge chamber by the blade 7. As the roller 6 conducts planetary movement, the blade 7 moves reciprocably.

As the roller 6 conducts planetary movement, a refrigerant gas is introduced into the refrigerant compressor via a suction port (not shown) and the compressed refrigerant gas is discharged through a discharge port (not shown).

To smoothen slidable movement of slidable portions in the refrigerant compressor, a refrigerator oil 9 is contained in the casing 1. As the shaft 2 is rotated, the refrigerator oil 9 is sucked up by a pump 10 fixedly mounted on the lower end of the shaft 2 to lubricate the slidable portions with the refrigerator oil 9.

An abrasion phenomenon appearing in the refrigerant compressor as constructed in the above-described manner is attributable to two causes associated with the blade 7 and the shaft 3.

The first cause is based on the fact that as the shaft 2 is rotated, the blade 7 reciprocably moves while coming in rubbing contact with the inner wall surface of the cylinder 4 under the effect of the differential pressure arising across the two chambers in the cylinder 4. In other words, the blade 7 slidably moves during its reciprocable movement while coming in local contact with the inner wall of the cylinder 4 within the annular clearance between the cylinder 4 and the roller 6. Because of the local contact, a high intensity of pressure (large load) arises on the slidable surface portion between the blade 7 and the cylinder 4. The reciprocable slidable movement of the blade 7 arises at two stop locations where the slidable speed of the blade 7 is reduced to a zero level. Because of the aforementioned two reasons, the surface of each slidable member is plastically deformed and the lubricant film is broken, causing the slidable parts to readily come in metallic contact with each other. For this reason, the blade 7 and the cylinder 4 are liable to readily be abraded. In addition, since the blade 7 is squeezed against the roller 6 by the spring 8 at its one end, the outer periphery of the roller 6 is liable to readily be abraded too.

The second cause is based on the fact that the shaft 2 is rotated at a high speed in the slightly bent state because it receives the resilient force of the spring 8 and the pressure in the cylinder 4 via the roller 6, causing it to be squeezed against the frame 3 and the bearing 5. At this time, the lubricant film is broken, whereby the surface of the shaft 2 readily comes in metallic contact with the frame 3 and the subbearing 5. Consequently, the outer surface of the shaft 2, the inner surface of the frame 3 and the inner surface of the subbearing 5 are liable to be abraded.

S. C. Kang and K. C. Ludema investigated the mechanisms of "break-in" of lubricant surfaces between a steel cylinder and a flat steel surface (S. C. Kang and K. C. Ludema, Wear, pages 375–384, 108(1986)) However, they did not published a report on $Fe_3O_4$ which was formed on a substrate of ferrous metallic material having a surface hardened layer.

A piston ring for an internal combustion engine having a nitrided layer formed on the slidable surface thereof, and moreover, having a layer of $Fe_3O_4$ formed on the surface thereof has been hitherto known (refer to an official gazette of Japanese Unexamined Publication Patent (Kokai) NO. 1-48388). However, the prior invention is concerned with an internal combustion engine and nothing is disclosed on the relationship not only between the piston ring and a refrigerant but also between the piston ring and a refrigerator oil.

A dichloro-difluoromethane (hereinafter referred to as CFC12) and a monochloro-difluoromethane (hereinafter referred to as CFC22) have been hitherto mainly employed as a refrigerant for the hermetic type refrigerant compressor as mentioned above. In addition, a naphthene based mineral oil and a paraffin based mineral oil in which CFC12 and CFC22 are soluble have been employed as a refrigerator oil to be contained in the casing of the refrigerant compressor.

In case that CFC 12 is used as a refrigerant, chlorine atoms in CFC12 react with iron atoms in a substrate of metallic material to form a lubricant film composed of an iron chloride. The lubricant film composed of iron chloride has self-lubricability and exhibits excellent abrasion resistance so that it prevents an occurrence of metallic contact between the slidable members when a high intensity of pressure (large load) is exerted on them and a speed of slidable movement of the slidable members is reduced to a level of zero. Thus, the lubricant film of iron chloride effectively functions to prevent abrasion of the slidable members. In addition, since the conventional refrigerant of CFC12 and the conventional refrigerator oil do not have a polarity, they have low moisture absorbability.

Therefore, the iron chloride film formed on the substrate of ferrous metallic material can be present as a stable film without any occurrence of hydrolysis.

A slidable member having such a three-layered structure that a layer of iron nitride is formed on a substrate of ferrous metallic material, a layer of oxynitride is formed on the iron nitride layer and a porous layer of $Fe_3O_4$ is formed as an outermost layer has been disclosed (refer to an official gazette of U.S. Pat. No. 4,944,663). This slidable member is intended to prevent a harsh boundary lubricating condition from arising in a refrigerant compressor by retaining a naphthene based refrigerator oil in the porous layer of $Fe_3O_4$ having a comparatively heavy thickness. However, the foregoing prior invention does not disclose a refrigerant compressor wherein a refrigerant of HFC134a or HFC152a and a refrigerator oil in which the refrigerant is soluble are employed therefor.

As is well known, in recent years, it has been found that emission of CFC based refrigerant to the environmental atmosphere leads to the destruction of an ozone zone which has a serious effect not only on human beings but also animals and plants. In view of the foregoing circumstances, it has been determined as an international policy that use of CFC12 and similar materials each having a high ozone depletion potential is stepwise reduced and the use of CFC12 and similar materials is strictly inhibited in future.

To cope with the present situation as mentioned above, a variety of development works have been conducted for providing refrigerants such as HFC134a, HFC152a each to be substituted for the refrigerant of CFC12. Each of HFC134a and HFC152a does not have chlorine atoms contained in each molecule, causing its ozone depletion potential to be reduced to a zero level. In addition, since thermal properties of each of HCF134a and HFC152a as a refrigerant are similar to those of CFC12, there is no need of largely changing the design of a compressing mechanism in the refrigerant compressor. Consequently, it is very advantageous to employ HFC134a and HFC152a as an alternative refrigerant to be substituted for CFC12.

In addition to the development of HFC134a and HFC152a, it becomes important to develop a material for the refrigerant compressor suitably employable for the alternative refrigerant as mentioned above. On the other hand, it is necessary to prevent a refrigerator oil from remaining in a refrigerating cycle during running of the refrigerant compressor, and moreover, return the refrigerator oil to a compressing mechanism in the refrigerant compressor without fail so as to properly lubricate and cool the compressing mechanism. Due to the foregoing necessity, when HFC134a or HFC152a is used as a refrigerant, a refrigerator oil to be used for the refrigerant compressor is required that the refrigerant is soluble therein. However, HFC134a and HFC152a are hardly dissolved in a mineral oil that is the conventional naphthane based refrigerator oil. In view of this fact, practical use of a polyether based oil, a polyester based oil and a fluorine based oil in which HFC134a and HFC152a are soluble has been tried.

However, when the HFC based refrigerant such as HFC134a and HFC152a and the refrigerator oil such as a polyether based oil, a polyester based oil or the like in which the HFC based refrigerant is soluble are used for the refrigerant compressor, there arises a problem that abrasion resistance of a ferrous metallic material such as a cast iron, a carbon steel, an alloy steel, a sintered alloy, a stainless steel or the like is increased, resulting in the refrigerant compressor failing to stably operate for a long time.

The following facts are considered as a cause for the foregoing problem.

Firstly, in case that CFC12 is used as a refrigerant, a film of iron chloride formed on a substrate of metallic material has self-lubricability and exhibits excellent abrasion resistance. On the other hand, in case that HFC134a or HFC152a is used as a refrigerant, since no chlorine atom is present in the refrigerant, a lubricant film composed of an iron chloride is not formed on the metallic substrate.

Secondly, a cyclic compound is contained in the naphthane based refrigerator oil, and it has a high ability of forming an oil film. On the other hand, since the refrigerator oil in which HFC134a or HFC152a are soluble is a chain compound containing no cyclic compound, it has a low ability of forming an oil film. For this reason, it is impossible to hold the oil film under a severe condition of slidable movement. In view of this fact, an additive such as an extreme pressure additive is added to the polyether based oil and the polyester based oil.

Generally, the polyether based oil and the polyester based oil have a high moisture absorbability, causing an organic insulating material using in the refrigerant compressor to be readily hydrolyzed. When the metallic substrate has a porous layer of $Fe_3O_4$ having a comparatively heavy thickness usable for a combination of the CFC based refrigerant with the naphthane based refrigerator oil, a hydrolyzed product is readily entrapped on the layer composed of $Fe_3O_4$, resulting in the lubricating property of the refrigerator oil being degraded. In addition, an additive to be added to the polyether based oil, the polyester based oil or the like is liable to promote hydrolysis of the organic insulating material. Thus, the lubricating property of the refrigerator oil is additionally degraded.

SUMMARY OF THE INVENTION

An object of the present invention is to provide a refrigerant compressor including slidable members which assures that abrasion of each slidable member can be reduced even when a high intensity of pressure (large load) is exerted on each slidable member and the speed of slidable movement of each slidable member is reduced to a zero level during operating the refrigerant compressor for which HFC134a or HFC152a is used as a refrigerant and e.g., a polyalkylen glycol based oil, a polyester based oil or the like is used as a refrigerator oil in which the refrigerant is soluble.

Other object of the present invention is to provide a refrigerant compressor of the foregoing type which assures that it can normally operate for a long time while HFC134a or HFC152a is used as a refrigerant and a polyalkylen glycol based oil or a polyester based oil is used as a refrigerator oil.

Another object of the present invention is to provide a refrigerant compressor of the foregoing type wherein each slidable member is prepared with a highly excellent dimensional accuracy.

Further object of the present invention is to provide a refrigerant compressor of the foregoing type which assures that the destruction of the environmental atmosphere can be reduced by employing as a refrigerant of HFC134a or HFC152a having an ozone depletion potential reduced to a zero level.

To accomplish the above objects, the present invention provides a hermetic type refrigerant compressor adapted to operate using a refrigerant and a refrigerator oil in which the refrigerant is soluble, the refrigerant compressor including slidable members adapted to slidably move and a compressing mechanism for compressing the refrigerant with the aid of the slidable members in a hermetic casing, wherein the refrigerant, the refrigerator oil and the slidable members are constructed and prepared in the following manner.

The refrigerant is at least one kind of refrigerant selected from 1,1,1,2-tetrafluoroethane or 1,1-difluoroethane, the refrigerator oil is at least one kind of refrigerator oil selected from a polyalkylen glycol based oil and a polyester based oil, and at least one of the slidable members has a slidable surface which is prepared such that a surface hardened layer having a Vickers hardness of 400 or more and a thickness of 2 microns or more is formed on a substrate of ferrous metallic material, and subsequently, an iron oxide layer composed of $Fe_3O_4$ as a main component and having a thickness of 0.01 micron or more is formed on the surface hardened layer.

According to the present invention, a ferrous metallic material employable for slidable members in an ordinary refrigerant compressor can be employed as a substrate of ferrous metallic material to be used for the slidable members. For example, a carbon steel, an alloy steel, a cast iron, a sintered alloy, a stainless steel or the like can be noted as a substrate of ferrous metallic material.

Provided that the surface hardened layer formed on the substrate of ferrous metallic material is a surface hardened layer usable for slidable parts in an ordinary refrigerant compressor, there does not arise any particular problem. The surface hardened layer can be formed by employing, e.g., a nitriding process, a cementation process, a boriding process, a metal diffusing process or the like. Among the various kinds of surface hardening processes as mentioned above, especially, the nitriding process is preferably employable because surface treatment can be conducted at a high speed and an uniform surface hardened layer can be formed on each of many parts by employing this process. When the surface hardened layer is formed by employing the nitriding process, it is composed of an iron nitride as a main component. In this connection, any nitriding process selected from a nitriding process practiced using an ammonia gas, a nitriding process practiced with the aid of a molten salt bath and an iron nitriding process can be employed to form a layer of iron nitride.

It is necessary that the surface hardened layer has a Vickers hardness of 400 or more. This is because abrasion resistance of the surface hardened layer is improved when it has a Vickers hardness of 400 or more.

In addition, it is necessary that the surface hardened layer has a thickness of 2 microns or more. This is because a proof stress appearing on the surface of each slidable member is improved when the surface hardened layer has a thickness of 2 microns or more. It is more preferable that the surface hardened layer has a thickness of 5 microns or more because the proof stress on the surface of each slidable member can be additionally improved.

The iron oxide layer composed of $Fe_3O_4$ as a main component may be formed on the surface hardened layer by employing any type of process of forming a layer of iron oxide.

Among various kinds of processes each forming a layer of iron oxide, it is recommendable for carrying out the present invention to employ a molten salt oxidizing process and a hot steam treating process because each of them can be practiced at a comparatively low temperature.

The molten salt oxidizing process is a process which is practiced by dipping a substrate of ferrous metallic material having a surface hardened layer preformed thereon in a molten salt bath containing $NO_3$ ions while exhibiting oxidizability e.g. at 380° C. for about 10 minutes.

In addition, the hot steam treating process is a process which is practiced by blowing hot steam onto the substrate of ferrous metallic material having a surface hardened layer preformed thereon under a temperature condition of about 500° C. or less.

In case that the surface hardened layer is composed of an iron oxide as a main component, the iron oxide layer composed of $Fe_3O_4$ as a main component is continuously formed on the surface of the iron oxide layer at a comparatively low temperature of about 500° C. or less by employing each of the aforementioned two processes. Thus, slidable members each having a highly excellent dimensional accuracy can be obtained with these processes.

The aforementioned two processes make it possible to uniformly treat a number of parts. The iron oxide layer composed of $Fe_3O_4$ as a main component exhibits a porous state so as to enable a lubricant or the like to be impregnated therein.

The iron oxide layer is required to have a thickness of 0.01 micron or more. When it has a thickness of 0.01 micron or more, a lubricant impregnating property of the iron oxide layer can stably be maintained in the wide range of slidable movement condition. It is not desirable that the iron oxide layer has an excessively heavy thickness, because gas leak or the like occurs on a slidable surface. For this reason, a preferably employable thickness of the iron oxide layer ranges from 0.1 micron to 2 microns.

When the iron oxide layer has a thickness of 0.01 micron but less than 0.1 micron, slidable members each having an additionally improved dimensional accuracy can be obtained.

FIG. 3 is a fragmentary sectional view of a slidable member employable for the refrigerant compressor of the present invention.

As shown in FIG. 3, the slidable member is constructed such that a surface hardened layer 12 is formed on a substrate 11 of ferrous metallic material, and subsequently, an iron oxide layer 13 is formed on the surface hardened layer 12.

The iron oxide layer 13 may be formed after the surface hardened layer 12 is first formed with a comparatively heavy thickness of several ten microns and it is then subjected to cutting to reach a predetermined thickness. In this case, a slidable member having a highly excellent dimensional accuracy can be obtained. Since the dimensional accuracy is an especially important factor for each slidable member employable for the refrigerant compressor, it is preferable that the iron oxide layer 13 is formed at a temperature of about 500° C. or less.

The slidable member having a double layered-structure as mentioned above exhibits the following function on the slidable surface of a compressing mechanism.

Firstly, the proof stress on the surface of each slidable member is improved by the presence of a hardened layer. Thus, plastic deformation of two slidable members adapted to slidably move relative to each other can reliably be prevented when a high intensity of pressure (large load) is exerted on the slidable surface of each of the slidable members.

Secondarily, the refrigerator oil impregnated in the porous iron oxide layer composed of $Fe_3O_4$ as a main component oozes on the surface of each slidable member when the lubricant film is broken at a zero speed of slidable movement. Thus, the lubricated state of each slidable member can be maintained at all times. In other words, the surface of each member has a hard lubricant film, metallic contact between slidable members each composed of a substrate of ferrous metallic material can be prevented. $Fe_3O_4$ that is a main component does not have self-lubricability but has a high Vickers hardness of 1400 and a high melting point. For this reason, a lubricant impregnation property can be maintained within the wide range of a slidable movement condition.

As is apparent from the drawing, the slidable member is prepared in the form of a slidable part including a treated layer having a double-layered structure on a substrate of ferrous metallic material consisting of a surface hardened layer formed by reforming the substrate itself and an iron oxide layer formed by oxidizing the surface hardened layer. Thus, the slidable member exhibits excellent adherence not only along the boundary between the iron oxide layer and the surface hardened layer but also along the boundary between the surface hardened layer and the substrate of ferrous based metallic material. With such construction, there do not arise problems that cracks occur on the surface of each slidable member and one layer of the slidable member is peeled away from the other layer of the same. In addition, since the iron oxide layer has a small thickness ranging from 0.01 micron to 2 microns, each slidable member has excellent dimensional accuracy.

The refrigerant compressor constructed using slidable members as mentioned above includes a motor mechanism having a driving section, a compressing mechanism accommodated in a hermetic casing having a refrigerant of HFC134a or HFC152a and a refrigerator oil in which the refrigerant is soluble contained therein while including a cylinder and slidable members each adapted to come in slidable contact with the cylinder for compressing the refrigerant, and transmission means such as a shaft or the like operatively connected to the driving section of the motor mechanism and the slidable members in the compressing mechanism to transmit the driving force generated by the motor mechanism to the compressing mechanism.

According to the present invention, one slidable member in the refrigerant compressor is used as, e.g., a part of the shaft. Another slidable member is used as a slidable part in the compressing mechanism. For example, a cylinder, a rotor serving as a movable member, a piston and a blade in a rotary type refrigerant compressor can be noted as a slidable part in the compressing mechanism.

When the slidable members as mentioned above are used for the refrigerant compressor having HFC134a or HFC152a employed as a refrigerant and having a refrigerator oil in which the refrigerant is soluble, e.g., a polyether based oil, a fluorine based oil, a polyester based oil or the like employed therefor, abrasion resistance of each slidable member can be improved. Consequently, excellent abrasion resistance property of the refrigerant compressor can be maintained for a long time.

DESCRIPTION OF PREFERRED EMBODIMENTS

Now, the present invention will be described in detail hereinafter with reference to a few embodiments of the present invention.

EMBODIMENT 1

Figure 1:
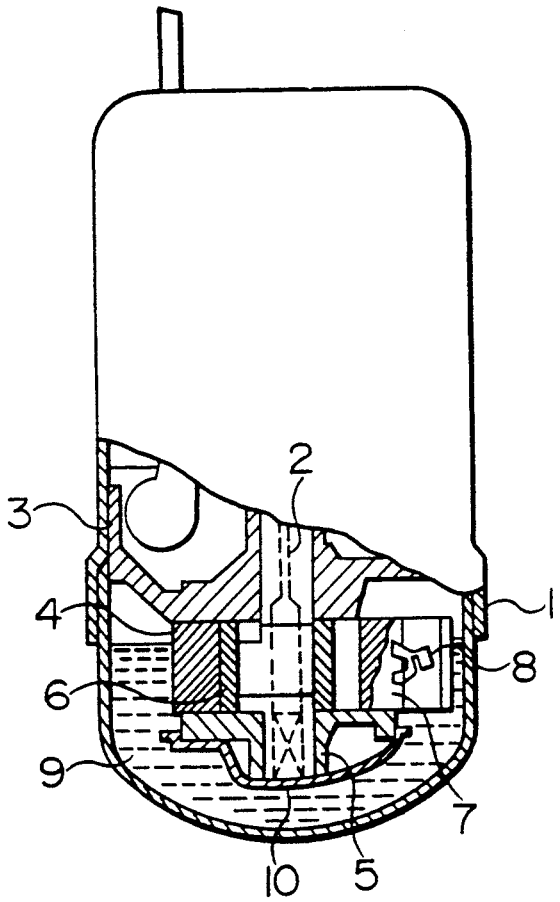
FIG. 1 is a fragmentary sectional view of a hermetic type rotary refrigerant compressor.

A slidable member to which the present invention is applied will be described below as to an embodiment wherein the slidable member is employed for a blade 7 in a hermetic type rotary refrigerant compressor as shown in FIG. 1. Incidentally, since the structure of the hermetic type rotary refrigerant compressor employed in this embodiment is coincident with that of a conventional type rotary refrigerant compressor as shown in FIG. 1, description will be made below with reference to FIG. 1.

In the Embodiment 1, the blade 7 was produced in the following manner.

Specifically, a substrate of a chromic molibdenum steel (SCM435) was cut to a predetermined shape, and thereafter, the substrate having the predetermined shape was dipped in a molten salt bath composed of a sodium cyanide (NaCN) as a main component and having a temperature 550° C. for 30 minutes so that a layer of iron nitride having a thickness of about 5 microns was formed over the surface of the substrate. Next, the blade was heated up to an elevated temperature ranging from 350° to 450° C., and after the temperature over the blade was stabilized, a steam was blown to the blade to form a layer of iron oxide composed of $Fe_3O_4$ as a main component and having a thickness of about 0.2 micron on the surface of the blade.

A part of the blade thus obtained was cut so that it was analyzed in the direction of the sectioned plane in accordance with a scanning type Auger electron spectroscopy analysis (AES) and a X-ray photoelectron spectroscopy analysis (XPS) so as to examine the surface structure of the blade prepared in this embodiment.

Figure 4:
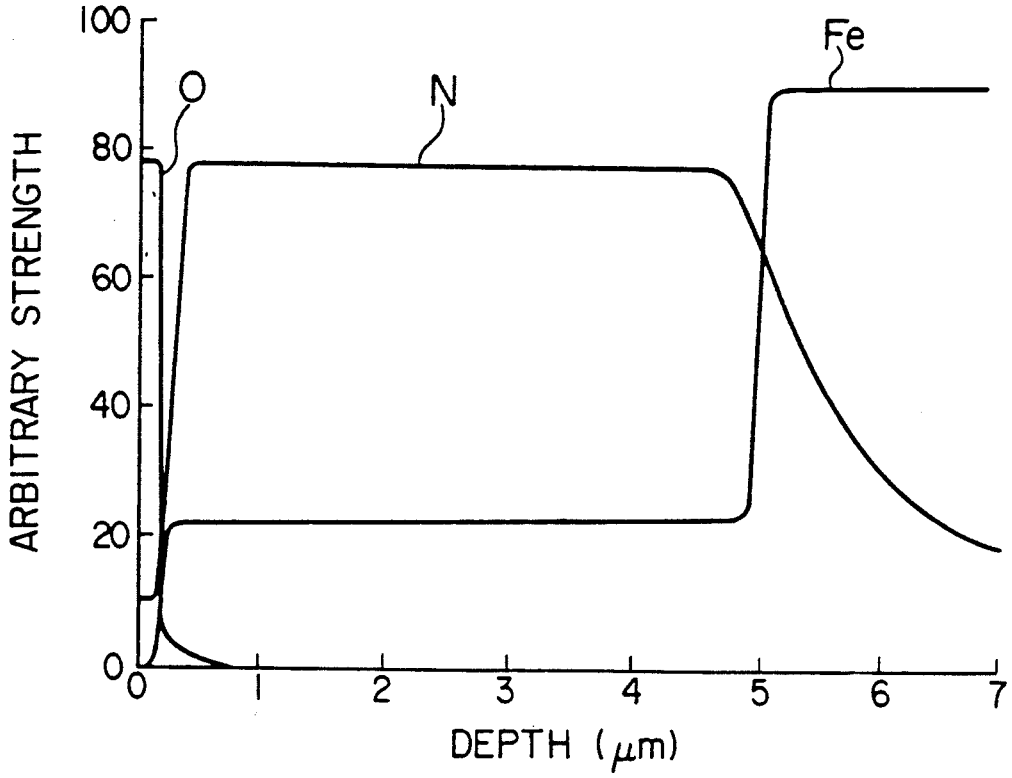
FIG. 4 is a diagram which illustrates a profile as seen in the direction of a depth in a scanning type Auger electron spectroscopy analysis in Embodiment 1.
Figure 5:
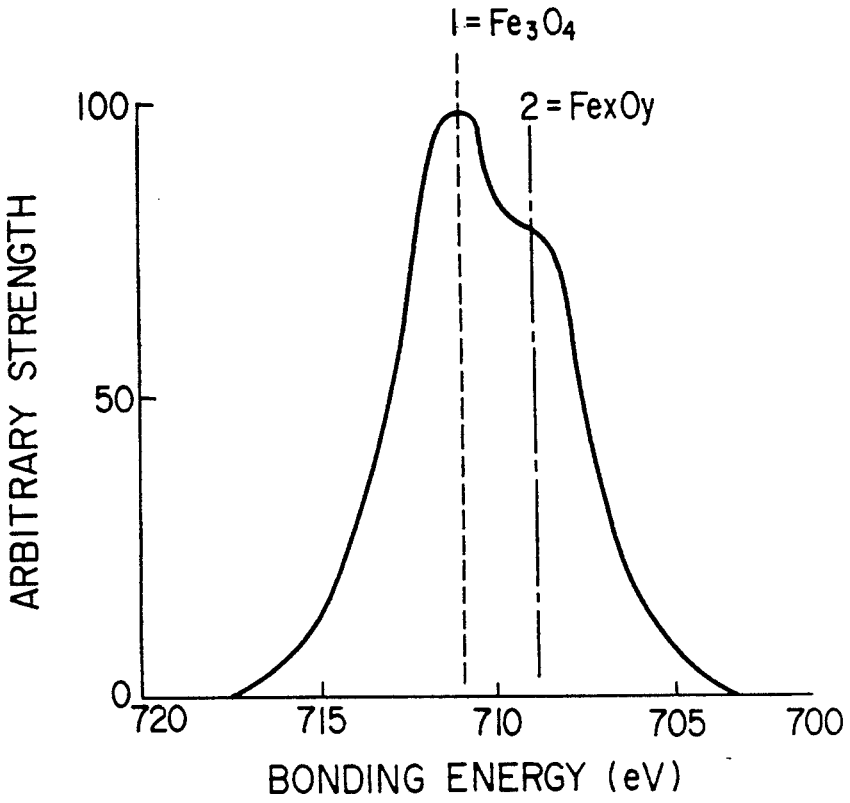
FIG. 5 is a diagram which illustrates a $Fe_{2p}$ photoelectronic spectrum in a X-ray photoelectron spectroscopy analysis in the Embodiment 1.

Referring to FIG. 4, the surface treated layer having a double-layered structure comprising a layer of iron nitride and a layer of iron oxide was recognized over the surface of the blade. In addition, referring to FIG. 5, a layer of iron oxide composed of $Fe_3O_4$ as a main component was recognized over the surface of the blade. Consequently, in this embodiment, it was recognized that the blade has a continuous surface structure including a surface hardened layer 12 and an iron oxide layer 13 on a substrate 11 of ferrous metallic material.

Figure 6:
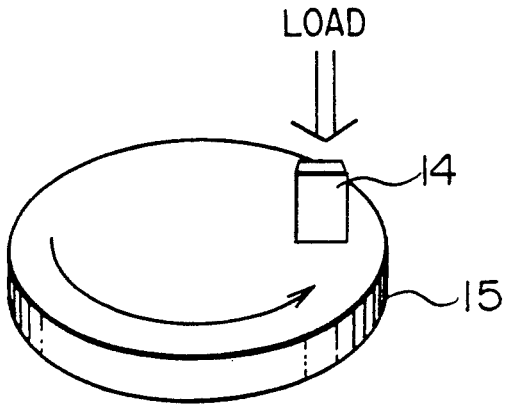
FIG. 6 is a schematic perspective view of a device employable for evaluating resistibility against hot seizure and a dynamic frictional coefficient.

Subsequently, resistibility against hot seizure and a dynamic frictional coefficient of the blade were evaluated by using a device as shown in FIG. 6.

This device was constructed such that the blade 14 was placed on a disc 15 made of a cast iron FC25 while coming in close contact with the disc 15 and the blade 14 was rotated so as to allow the blade 14 to assume a predetermined sliding speed while receiving a load given from above by actuating a pressure generating unit. With this device, the value representing the given load was continuously varied, and variation of the dynamic frictional coefficient and the load value generating hot seizure with the blade 14 at that time were measured.

A polyol type polyester based oil was used as a lubricant for the test for determining the resistibility against hot seizure, and the relationship between the load and the dynamic frictional coefficient and the value representing the load causing the hot seizure were examined under set conditions that the sliding speed was set to a constant value of 4 m/s, a load increasing speed was set to 10 kgf/cm$^2$/2 min. and a maximum load was set to 350 kgf/cm$^2$. These test conditions were recognized as conditions for promoting breakage of a lubricant film due to a highly increased sliding speed.

Figure 7:
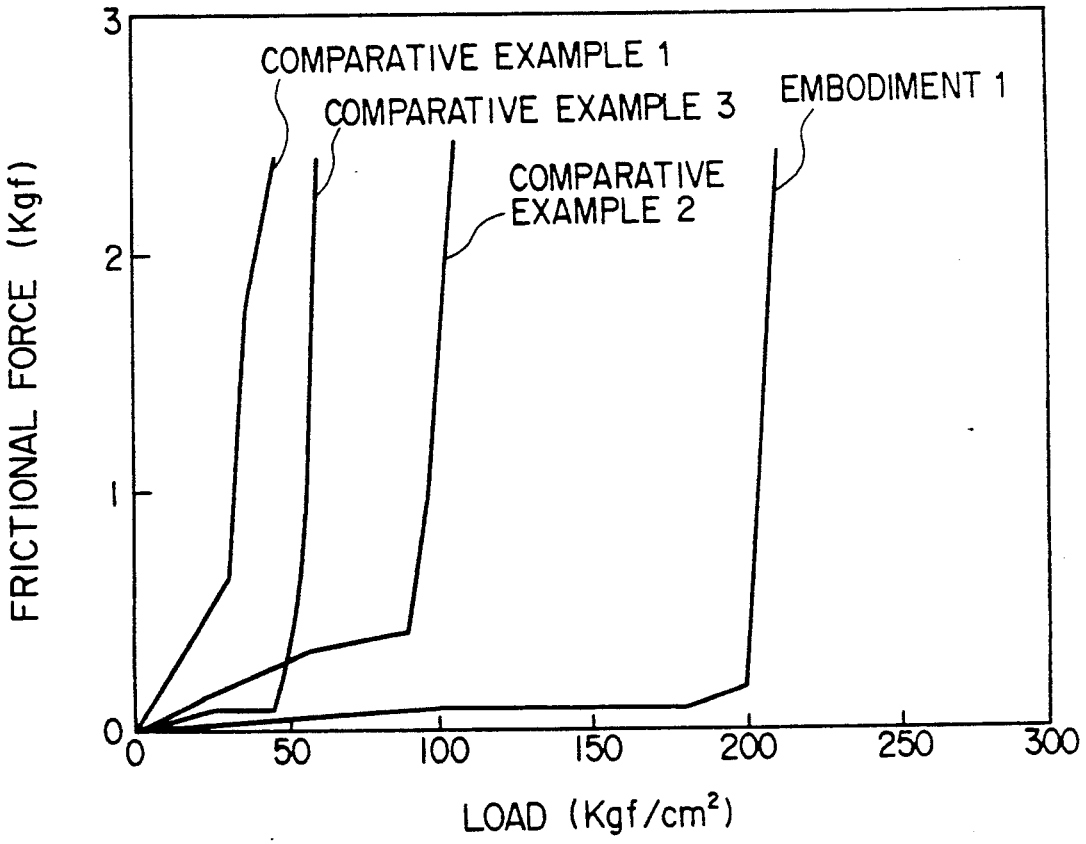
FIG. 7 is a graph which illustrates results obtained from evaluation on the resistibility against hot seizure and the dynamic frictional coefficient.

Results obtained from evaluations on the property of resistibility against hot seizure and the dynamic frictional coefficient are shown in FIG. 7.

It should be noted that comparative examples shown in FIG. 7 represent the cases that the following materials were substituted for the material employed for the blade 7 in the same hermetic type rotary refrigerant compressor as that in the Embodiment 1.

The Comparative Example 1 was such that an alloy steel of SCM 35 receiving no surface treatment was substituted for the alloy steel SCM 435 in the Embodiment 1, the Comparative Example 2 was such that an alloy steel of SCM435 subjected only to nitriding treatment under the same conditions as those in the Embodiment 1 was substituted for the same, and the Comparative Example 3 was such that an alloy steel of SCM435 subjected only to oxidizing treatment under the same conditions as those in the Embodiment 1 was substituted for the same.

As is apparent from FIG. 7, the dynamic frictional coefficient of the blade 7 had good evaluation when the load given thereto increased but the frictional force did not increase. On the other hand, the resistibility of the blade 7 against hot seizure exhibited a good evaluation as a slidable member when the device employed the blade 7 as identified by the range where each curve extends in the rightward/downward direction more and more, because hot seizure hardly took place.

Referring to FIG. 7 again, it was recognized that hot seizure took place at the maximum load of 40 kgf/cm$^2$ with the blade material in the Comparative Example 1, it took place at the maximum load of 100 kgf/cm$^2$ with the blade material in the Comparative Example 2 and it took place at the maximum load of 60 kgf/cm$^2$ with the blade material in the Comparative Example 3, and each blade material had a degraded property of resistance against hot seizure. In contrast with the Comparative Examples, however, in the Embodiment 1, the dynamic frictional coefficient had a small value in full load range, and moreover, the value representing the hot seizure load was improved more than twice compared with the Comparative Example 1.

In addition, a series of abrasion resistance tests were conducted under a condition of a constant load of 70 kgf/cm$^2$ by using the same device as mentioned above.

It was clarified from the results obtained from these tests that the blade material employed in the Embodiment 1 exhibited a remarkably good abrasion resistance as represented by an abrasion quantity of 10% or less compared with the Comparative Example 2, and moreover, the slidable member in the Embodiment 1 contributed to improvement of the abrasion resistance.

The refrigerant compressor as shown in FIG. 1 was assembled using the slidable member in the Embodiment 1, and thereafter, a series of practical operation tests were conducted by using HFC134a as a refrigerant as well as a polyester based refrigerator oil in which HFC134a is soluble as a refrigerator oil. Even after the refrigerant compressor was operated for a long time of 4000 hours, a trace of abrasion was not recognized with the slidable member but it exhibited excellent abrasion resistance.

EMBODIMENT 2

Figure 2:
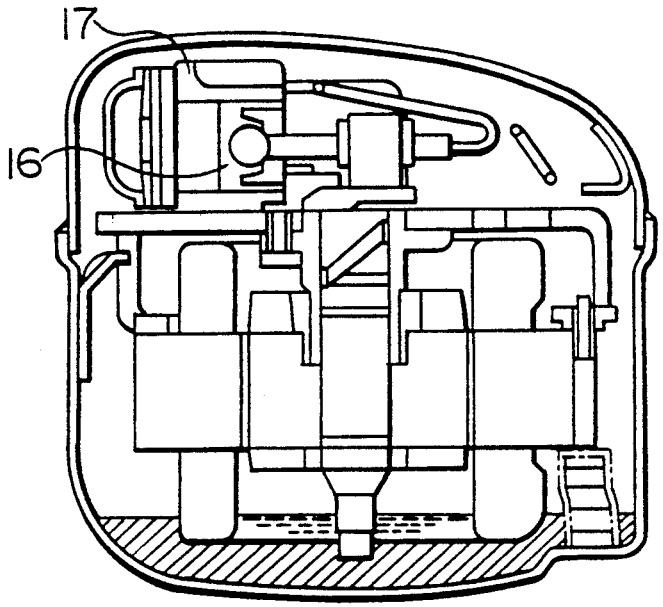
FIG. 2 is a vertical sectional view of a hermetic type reciprocable refrigerant compressor.
Figure 3:
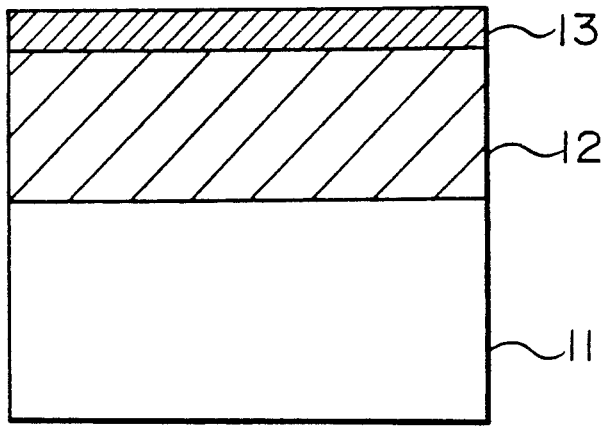
FIG. 3 is a fragmentary sectional view of a slidable member employable for a refrigerant compressor in accordance with the present invention.

A slidable member of the present invention will be described below as to an embodiment wherein it was employed for a piston 16 for the hermetic type reciprocable refrigerant compressor shown in FIG. 2.

The piston 16 was a part adapted to reciprocably move in an opponent component of cylinder 17 made of a cast iron FC25 while receiving the pressure which varied over the foremost end surface of the piston 16. Similarly to the Embodiment 1, the piston 16 slidably moved in the cylinder 17 with a local contact with the inner wall surface of the cylinder 17 in the annular clearance between the piston 16 and the cylinder 17.

The piston 16 was made of a substrate of steel material S15C and subjected to surface treatment by employing the same process as that in the Embodiment 1.

A series of practical operation tests were conducted with the refrigerant compressor by using HFC134a as a refrigerant and a polyester based refrigerator oil in which HFC134a is soluble as a refrigerator oil.

The results obtained from the tests revealed that no abrasion was recognized with the piston even after a long operating time of 2000 hours, and moreover, the piston exhibited excellent abrasion resistance.

In addition, a series of practical operating tests were conducted in the same manner as the Embodiment 1 using a piston made of the same material as that in the Comparative Example 1. The results obtained from the tests revealed that abrasion attributable to shortage of lubricability was recognized on the slidable surfaces of the piston 16 and the cylinder 17.

EMBODIMENT 3

The same blade as that in the Embodiment 1 was prepared in the following manner.

Specifically, a substrate of chromic molibdenum steel (SCM435) was cut to a predetermined shape, and thereafter, the substrate having the predetermined shape was dipped in a molten salt bath composed of a sodium cyanide (NaCN) as a main component and having a temperature of 550° C. for 30 minutes so that a layer of iron nitride having a thickness of about 10 microns was formed over the surface of the substrate. The iron nitride layer thus formed was cut until the thickness of the iron nitride layer was reduced to 5 microns. Next, the blade was heated up to an elevated temperature ranging from 350° to 450° C., and after the temperature over the blade was stabilized, a steam was blown to the blade to form a layer of iron oxide composed of $Fe_3O_4$ as a main component and having a thickness of about 0.2 micron on the surface of the blade. A series of practical operation tests were conducted with the same hermetic type rotary refrigerant compressor as that in the Embodiment 1 by using the thus prepared blade. The results obtained from the tests revealed that a trace of abrasion was not recognized with the slidable member even after a long operating time of 4000 hours, and moreover, the slidable member exhibited excellent abrasion resistance.

We claim:

1. A hermetic type refrigerant compressor comprising:

a refrigerant, being at least one kind of refrigerant selected from a 1,1,1,2-tetrafluoroethane and 1,1-di-fluoroethane;

a refrigerator oil in which said refrigerant is soluble, said refrigerator oil being at least one kind of refrigerator oil selected from a polyalkylene glycol based oil and a polyester based oil;

a compressing mechanism having slidable members for compressing said refrigerant, said slidable members being capable of sliding relative to each other; and a hermetic casing, with said refrigerant, said refrigerator oil and said compressing mechanism being disposed therein;

wherein a slidable surface of at least one of said slidable members comprises:

a substrate of ferrous metallic material;

a surface hardened layer having a Vickers hardness of 400 or more and a thickness of 2 microns or more, said surface hardened layer being formed on said substrate of ferrous metallic material; and, an iron oxide layer consisting essentially of $Fe_3O_4$ and having a thickness of 0.01 micron or more, said iron oxide layer being formed on said surface hardened layer.

2. The refrigerant compressor according to claim 1, wherein said surface hardened layer on said ferrous metallic material for each slidable member has a thickness of 5 microns or more.

3. The refrigerant compressor according to claim 1, wherein said iron oxide layer on said surface hardened layer for each slidable member has a thickness ranging from 0.1 micron to 2 microns.

4. The refrigerant compressor according to claim 1, wherein said iron oxide layer on said surface hardened layer for each slidable member has a thickness of 0.01 micron or more but less than 0.1 micron.

5. The refrigerant compressor according to claim 1, wherein said surface hardened layer formed on said substrate of ferrous metallic material for each slidable member consists essentially of an iron nitride.

6. The refrigerant compressor according to claim 1, wherein said surface hardened layer on said substrate of ferrous metallic material for each slidable member is a layer consisting essentially of an iron nitride and having a thickness of 5 microns or more.

7. The refrigerant compressor according to claim 1, wherein said refrigerator oil is a plyalkylen glycol based oil.

8. The refrigerant compressor according to claim 1, wherein said refrigerator oil is a polyester based oil.

9. A hermetic type refrigerant compressor comprising:

a refrigerant, being a 1,1,1,2-tetrafluoroethane;

a refrigerator oil in which said refrigerant is soluble, said refrigerator oil being a polyester based oil;

a compressing mechanism having slidable members for compressing said refrigerant, said slidable members being capable of sliding relative to each other; and a hermetic casing, with said refrigerant, said refrigerator oil and said compressing mechanism being disposed therein;

wherein a slidable surface of at least one of said slidable members comprises:

a substrate of alloy steel;

a surface hardened layer having a Vickers hardness of 400 or more and a thickness of 5 microns or more, said surface hardened layer being formed on said substrate of alloy steel; and an iron oxide layer consisting essentially of $Fe_3O_4$ and having a thickness of 0.01 micron or more but less than 0.1 micron, said oxide layer being formed on said surface hardened layer.

* * * * *